US007847136B2

(12) United States Patent
Nill et al.

(10) Patent No.: US 7,847,136 B2
(45) Date of Patent: Dec. 7, 2010

(54) DEVICE AND METHOD FOR RECOVERING FRACTIONAL HYDROCARBONS FROM RECYCLED PLASTIC FRACTIONS AND/OR OILY RESIDUES

(75) Inventors: Wolf-Eberhard Nill, Stuttgart (DE); Anton Schmillen, Gärtringen (DE)

(73) Assignee: Nill Tech GmbH, Holzgerlingen (DE)

( * ) Notice: Subject to any disclaimer, the term of this patent is extended or adjusted under 35 U.S.C. 154(b) by 736 days.

(21) Appl. No.: 11/579,939

(22) PCT Filed: Jan. 24, 2005

(86) PCT No.: PCT/EP2005/000661

§ 371 (c)(1),
(2), (4) Date: Nov. 8, 2006

(87) PCT Pub. No.: WO2005/071043

PCT Pub. Date: Aug. 4, 2005

(65) Prior Publication Data

US 2007/0227874 A1 Oct. 4, 2007

(30) Foreign Application Priority Data

Jan. 24, 2004 (DE) ..... 10 2004 003 667

(51) Int. Cl.
*C07C 1/00* (2006.01)
*B01J 19/18* (2006.01)

(52) U.S. Cl. ..... 585/241; 422/131; 422/135; 422/137; 196/98

(58) Field of Classification Search ..... 588/228; 585/241; 208/131; 201/2.5, 8, 23, 28, 29, 201/30, 45; 202/96, 118; 422/131, 135, 422/137; 196/98

See application file for complete search history.

(56) References Cited

U.S. PATENT DOCUMENTS 3,998,595 A * 12/1976 Oshima ..... 422/225
4,584,421 A 4/1986 Saito et al.

(Continued)

FOREIGN PATENT DOCUMENTS

CN 1284537 2/2001

(Continued)

*Primary Examiner*—N. Bhat
(74) *Attorney, Agent, or Firm*—Horst M. Kasper

(57) ABSTRACT

Fractional hydrocarbons are recovered from reclaimed plastic materials and/or from oily residues. The reclaimed plastic materials and/or residues are sorted according to type and compacted using a feed system (1,2,3,4) in the absence of air. Thereafter the compacted mass is fed to a melting tank (7) below the liquid level. There the compacted mass is heated, so that a separation occurs into a first liquid phase, a first gas phase and a residue fraction. Thereafter the liquid phase and the first gas phase are transported into an evaporation tank (20) in which a second liquid phase and a second gas phase are formed under continued heat input. The second liquid phase is transferred to a re-heater (23) and is additionally heated there under further heat input so that a third gas phase is formed. Thereafter the second gas phase from the evaporation tank (20) and the third gas phase from the re-heater (23) are conveyed to a cracking tower (27) where further cracking of the long-chained hydrocarbons into short-chained hydrocarbons takes place, and the resulting oil gas is then conveyed to a condenser (30) in which the oil gas is condensed to form liquid oil, wherein the oil constitutes the target product.

25 Claims, 8 Drawing Sheets

Figures 1A, 2:
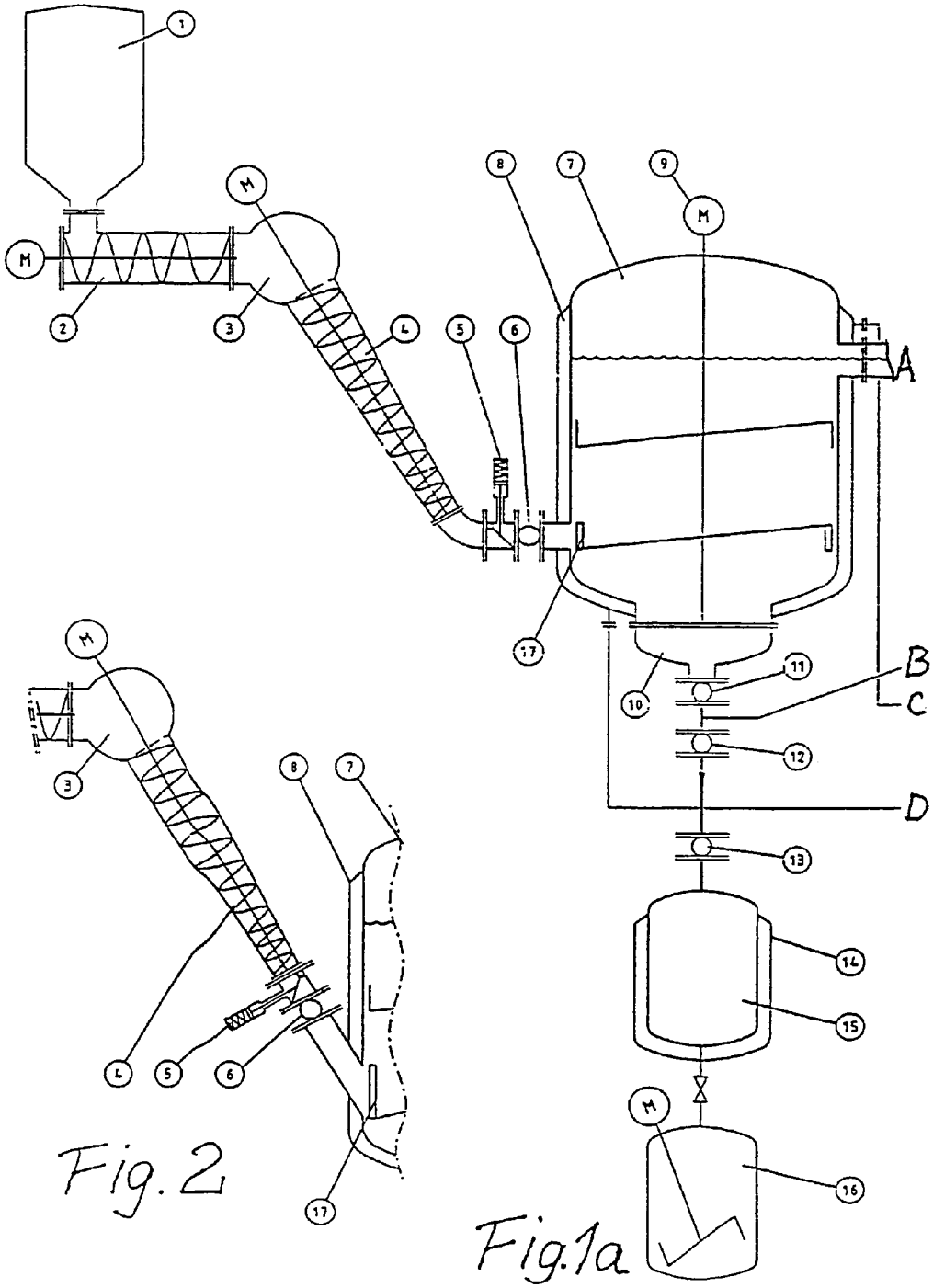

U.S. PATENT DOCUMENTS 4,871,426 A * 10/1989 Lechert et al. ..... 201/2.5
5,608,136 A * 3/1997 Maezawa et al. ..... 588/316
5,756,086 A * 5/1998 McClelland et al. ..... 424/93.2
5,973,217 A * 10/1999 Hastrich et al. ..... 585/241
6,011,187 A * 1/2000 Horizoe et al. ..... 585/241
6,881,303 B2 * 4/2005 Inoue et al. ..... 201/2.5

FOREIGN PATENT DOCUMENTS

JP 08034978 2/1996

* cited by examiner

DEVICE AND METHOD FOR RECOVERING FRACTIONAL HYDROCARBONS FROM RECYCLED PLASTIC FRACTIONS AND/OR OILY RESIDUES

This is a national phase application in the United States Patent and Trademark Office of a PCT-application under 35 U.S.C. 371 with the PCT-application having an application number PCT/EP2005/000661 and a filing date of Jan. 24, 2005.

FIELD OF THE INVENTION

The invention relates to a method for recovering fractional hydrocarbons from reclaimed plastic materials and/or from oily residues, said reclaimed plastic materials and/or residues being sorted according to type and compacted using a feed system, after which the compacted mass is fed to a melting tank where it is heated; the invention likewise relates to a device for carrying out the method for recovering fractional hydrocarbons from reclaimed plastic materials and/or from oily residues.

DESCRIPTION OF RELATED ART

Plastics are used in almost all realms of life nowadays and they have to be recycled and/or disposed of after being used. Disposal that takes health aspects into account poses considerable difficulties. Plastics such as poly-propylene (PP), polyethylene (PE) or polystyrene (PS), which consist of long-chained macromolecules, have to be cleaved into small molecules in order to be recycled. A conversion system can perform a low-temperature cracking process to convert such reclaimed plastic materials into an oil-like product containing gaseous admixtures and a solid residue.

The gas formed during the cracking process consists of a mixture of methane, ethane, ethylene, propane, propylene, 1-butene, 1-butane, 1-butene, 1-butane, pentane, etc. as well as a small residue of water vapor. The oil obtained from polystyrene consists of over 50% styrenes and also contains 2-methyl-styrenes, toluenes, ethyl benzenes and benzenes. The oil obtained from polyethylene and polypropylene consists mainly of paraffins and olefins, and only contains small amounts of aromatic compounds. The low-volatility residues consist of cokes, long-chained hydrocarbons, that are similar to heavy oil. In a subsequent process step, the oil-like residue can be mixed with water. In this process, an oil-water emulsion is formed that can be used for the conversion of refuse to energy, for example, it can be burned as fuel.

Chinese patent specification CN 1284537A describes a method for recovering hydrocarbons such as gases or oils from reclaimed plastic materials, comprising a melting and cracking process with subsequent oil-gas separation as well as distillation of the oil mixture. For this purpose, plastic raw materials are melted and evaporated in a tank (melting and cracking reactor). The plastic raw materials are heated to 280° C. to 380° C. [536° F. to 716° F.] and cracked. The drawback here is the one-stage input of the requisite heat energy. Due to the high heat flow density, severe overheating occurs in certain areas. This then leads to the formation of encrustations that have a negative impact on the further heat input. As a result, the heat consumption is high relative to the yield. Chinese patent specification CN 2435146Y has also disclosed a similar method.

TECHNICAL OBJECTIVE

The invention is based on the objective of refining the above-mentioned method and device in such a way that the energy input is improved and that the efficiency of the method and of the device is improved, especially through an optimal and systematic energy utilization and through heat recuperation in various areas.

DISCLOSURE OF THE INVENTION AND OF ITS ADVANTAGES

This objective is achieved according to the invention by a method for recovering fractional hydrocarbons from reclaimed plastic materials and/or from oily residues, said reclaimed plastic materials and/or residues being sorted according to type and compacted in the absence of air using a feed system, after which the compacted mass is fed to a melting tank where it is heated, so that a separation occurs into a first liquid phase, a first gas phase and a residue fraction, after which the liquid phase and the first gas phase are transported into an evaporation tank in which a second liquid phase and a second gas phase are formed under continued heat input, whereby the second liquid phase is transferred to a re-heater and additionally heated there under further heat input so that a third gas phase is formed, after which the second gas phase from the evaporation tank and the third gas phase from the re-heater are conveyed to a cracking tower where further cracking of the long-chained hydrocarbons into short-chained hydrocarbons takes place, and the resulting oil gas is then conveyed to a condenser in which the oil gas is condensed to form liquid oil, whereby the oil constitutes the target product.

In another embodiment according to the invention, the method is carried out using a multi-circuit, indirect heating system that generates the process heat for the melting tank, for the evaporation tank and for the re-heater, whereby oil or salt or gas can be used as the heat-transfer medium. For this purpose, a non-condensable fraction of the oil gas can advantageously be fed to the heating system where it can be burned for purposes of thermal recovery. Consequently, the heating system comprises all components for supplying the melting tank and the evaporation tank with energy. The thermally recyclable by-products that are formed in this process—for instance, a fraction of an oil-water emulsion from the residue fractions from the melting tank as well as other non-recyclable gas fractions from the cracking tower as well as a gas fraction from a flame overvoltage protector—are advantageously used in the heating system for generating the primary process heat.

In addition, a maximum amount of heat from the area where the oil gas and residue are pre-cooled and from a cooling system is returned to the heating system. For this purpose, the condenser can consist of a pre-condenser and a main condenser, which can be connected to a multi-circuit cooling system. The excess heat from the pre-condenser, main condenser and residue pre-cooling tank is thus fed to the heating system. By the same token, the oil-water emulsion can be fed to the heating system where it can be burned for purposes of thermal recovery.

The method according to the invention advantageously has a low energy expenditure as well as an optimal energy utilization through heat recuperation, relative to the yield. In particular, the heat circulation system advantageously provides indirect and targeted heat in the various process areas. In particular, the method according to the invention can utilize reclaimed plastic materials in accordance with the waste utilization regulations.

In another embodiment according to the invention, a pre-condenser and a main condenser are used as the condenser, whereby the excess heat from the pre-condenser, main condenser and residue pre-cooling tank is fed to the heating system, and the main condenser is connected to a multi-circuit condensation system.

In another embodiment according to the invention, the reclaimed plastic materials and/or the oily residues are comminuted in a pretreatment process after having been sorted and, if applicable, they are dried before the cracking process is carried out. The reclaimed plastic materials are sorted into PP, PE and PS into hard and soft plastic fractions. Since the water fraction in the plastics should be less than 1% for energy-related reasons, plastics with a higher water fraction should be dried first. In order to feed the reclaimed plastic materials and/or the oily residues into the melting tank, a tamping auger or tamping mechanism that compacts the residues in order to remove the oxygen can be used within the feed system. By the same token, the reclaimed plastic materials should be fed to the tamping auger or tamping mechanism in finely shredded form.

In another inventive embodiment of the method, the residue fraction is transported inside the melting tank into a sedimentation compartment located underneath where the residue fraction is concentrated and subsequently the concentrated residue fraction is transferred into a residue pre-cooling tank where the residue fraction is cooled by means of a cooling medium, preferably to a temperature below 120° C. [248° F.]. The cooled residue fraction can be fed to an emulsion unit in which an oil-water emulsion is produced from the residue fraction.

In another embodiment of the method, a pre-condenser is arranged between the cracking tower and the main condenser, whereby the pre-condenser pre-cools the oil gas and recovers heat at a high temperature level and also reduces the temperature gradient between the cracking tower and the main condenser. Moreover, the main condenser and optionally the pre-condenser can be connected to a multi-circuit cooling system.

The method according to the invention is preferably carried out between 300° C. and 450° C. [572° F. and 842° F.] and between normal pressure and overpressure of up to 2 bar.

A device according to the invention for recovering fractional hydrocarbons from reclaimed plastic materials and/or from oily residues, said reclaimed plastic materials and/or residues being sorted according to type, is characterized by a feed system for compacting the reclaimed plastic materials and/or the oily residues in the absence of air, as well as by a downstream melting tank for heating and melting the compacted mass in order to create a first liquid phase, a first gas phase and a residue fraction, whereby an evaporation tank is arranged downstream from the melting tank in order to create a second liquid phase and a second gas phase under continued heat input, said evaporation tank being upstream from a re-heater for purposes of feeding and further heating the second liquid phase so as to create a third gas phase, and a cracking tower is connected to the evaporation tank and to the re-heater in order to separate the resulting oil gas from the heavy oil as well as from non-evaporated reclaimed plastic materials, and a main condenser is connected to the cracking tower in order to condense the oil gas to form liquid oil.

In another embodiment of the device, in order to feed the reclaimed plastic materials and/or the oily residues into the melting tank, a tamping auger or tamping mechanism for compacting the reclaimed plastic materials and/or the oily residues is arranged within the feed system and, if applicable, a spherical transfer tank is located upstream from said tamping auger or tamping mechanism for purposes of transferring material into the tamping auger or tamping mechanism. The outlet of the tamping auger or tamping mechanism opens into the melting tank below the liquid level of the melted mass.

In another embodiment of the device, it has a multi-circuit heating system for generating the necessary process heat at a temperature level that has been optimized for this purpose, whereby oil or salt or gas serves as the heat-transfer medium.

In another embodiment of the device, a sedimentation compartment is arranged underneath the melting tank in order to receive the residue fraction. A residue pre-cooling tank with an emulsion unit connected to it can be arranged on the sedimentation compartment in order to produce an oil-water emulsion from the residue fraction.

In another embodiment of the device, the condenser consists of a main condenser and a pre-condenser, whereby the pre-condenser is arranged between the cracking tower and the main condenser in order to pre-cool the oil gas. Moreover, a multi-circuit cooling system can be connected to the main condenser.

In another embodiment, the device has a multi-circuit heating system for generating the process heat for the melting tank, evaporation tank and re-heater.

Furthermore, the melting tank and the evaporation tank as well as, if applicable, the re-heater, have an exterior heating jacket and/or interior heating coils, which can be heated up by means of the shared heating system for the heat-transfer medium.

BRIEF DESCRIPTION OF THE DRAWINGS, IN WHICH THE FOLLOWING IS SHOWN

Figure 1B:
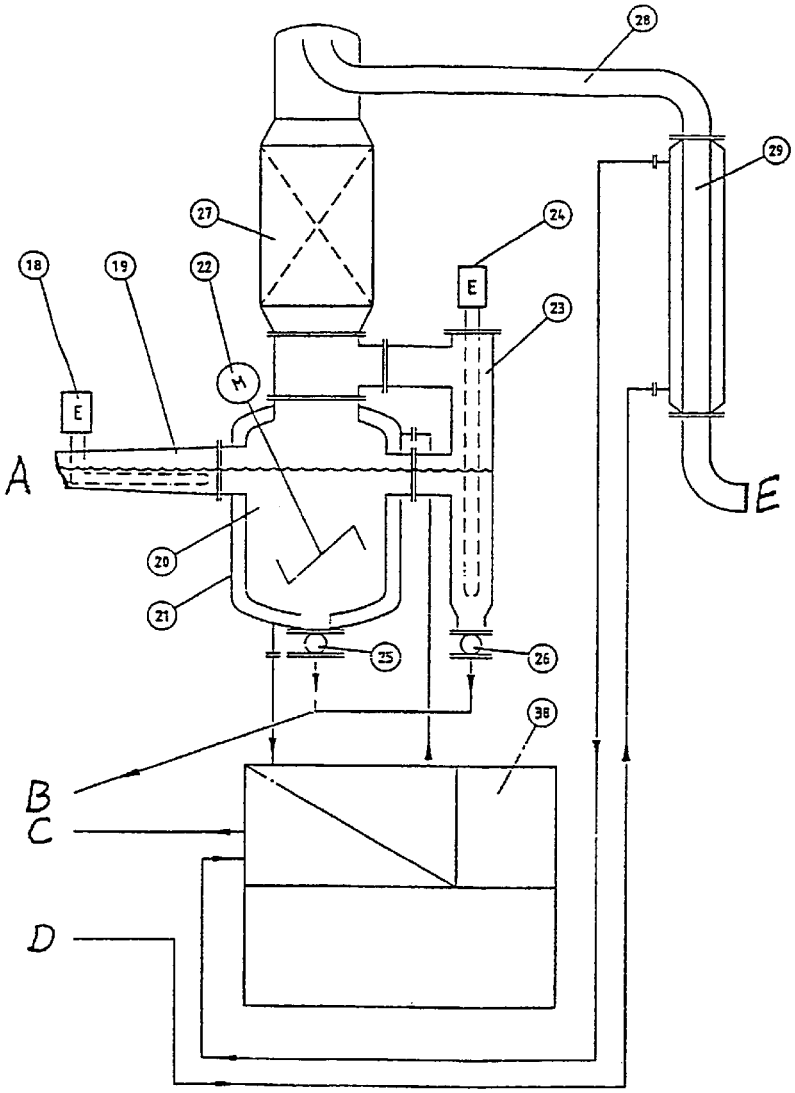
Figure 1C:
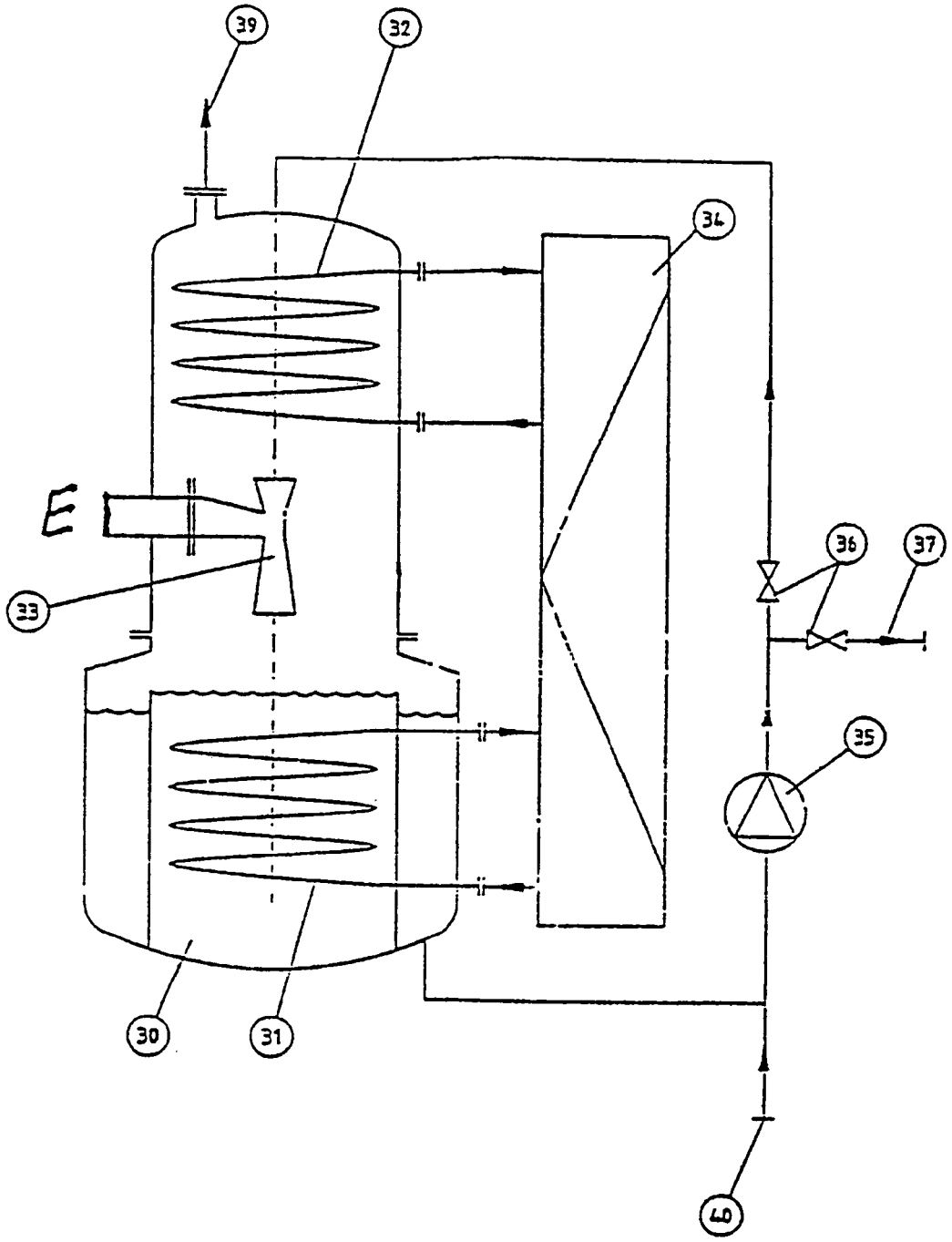
Figure 3:
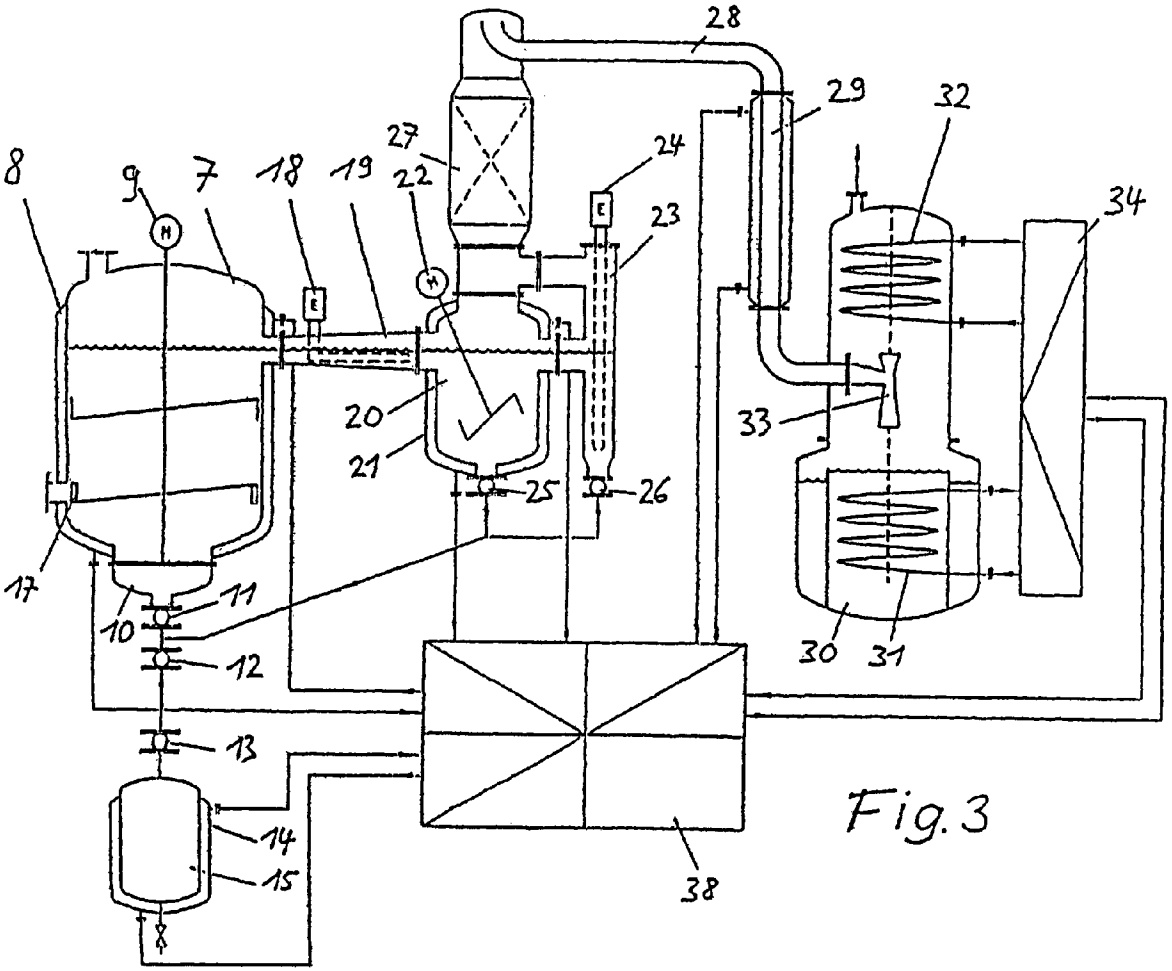
Figure 4:
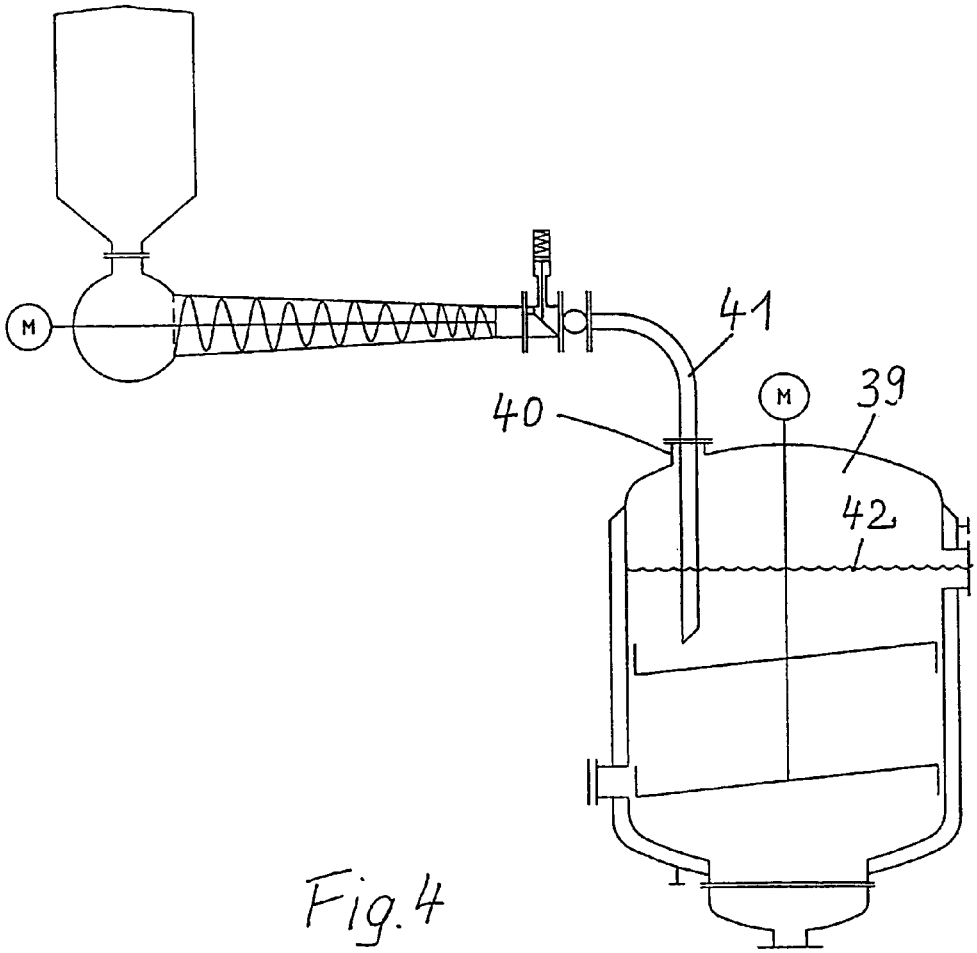
Figure 5:
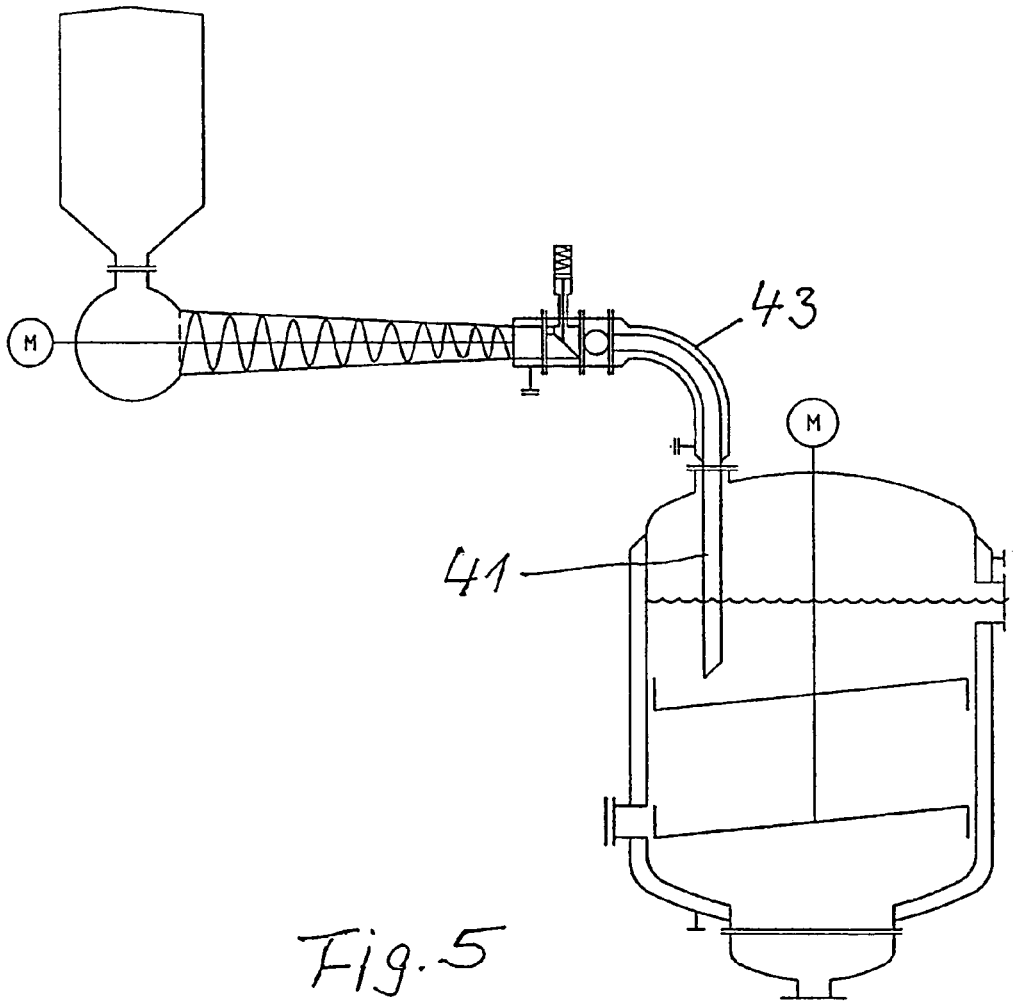
Figure 6:
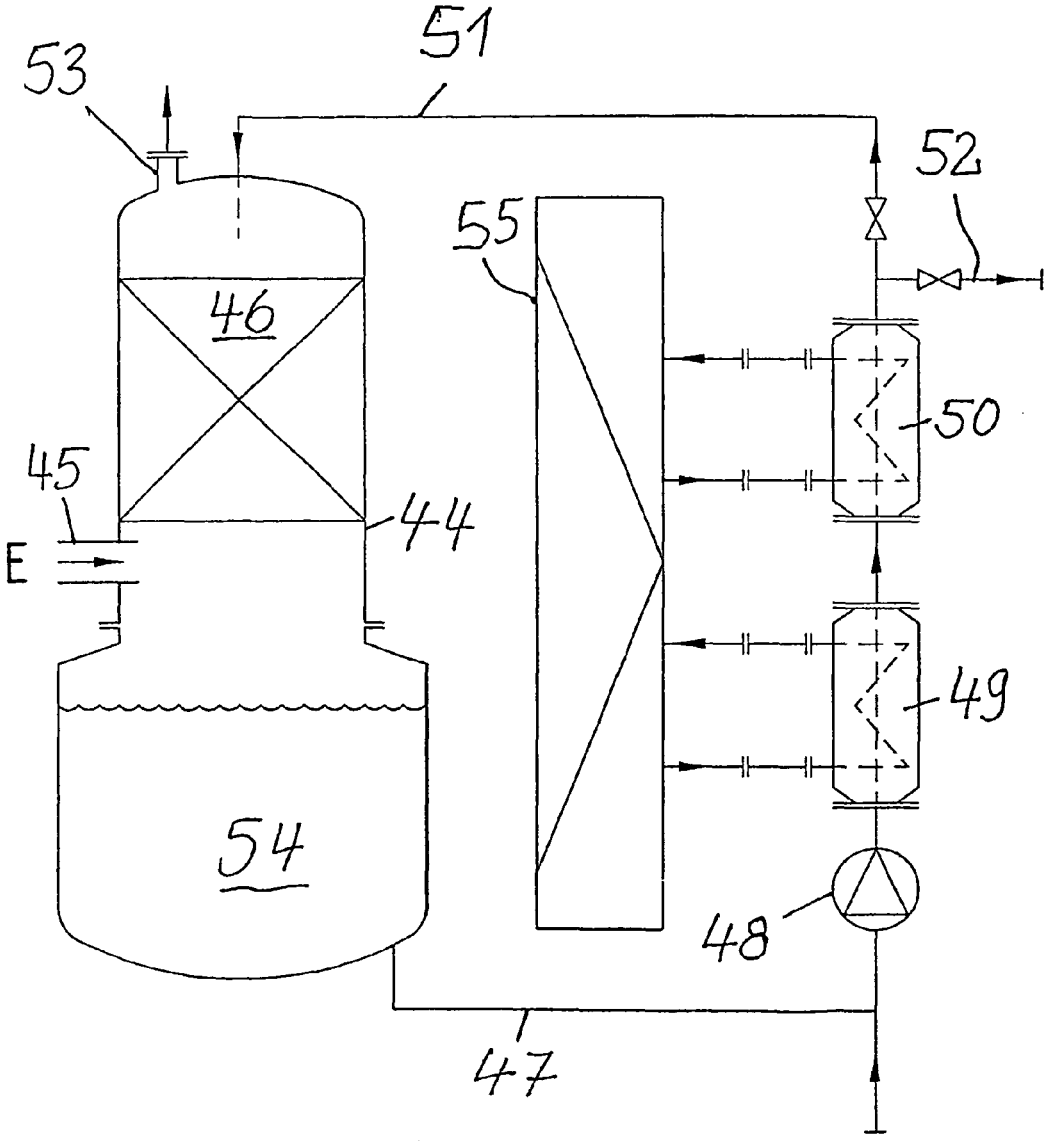
Figure 7:
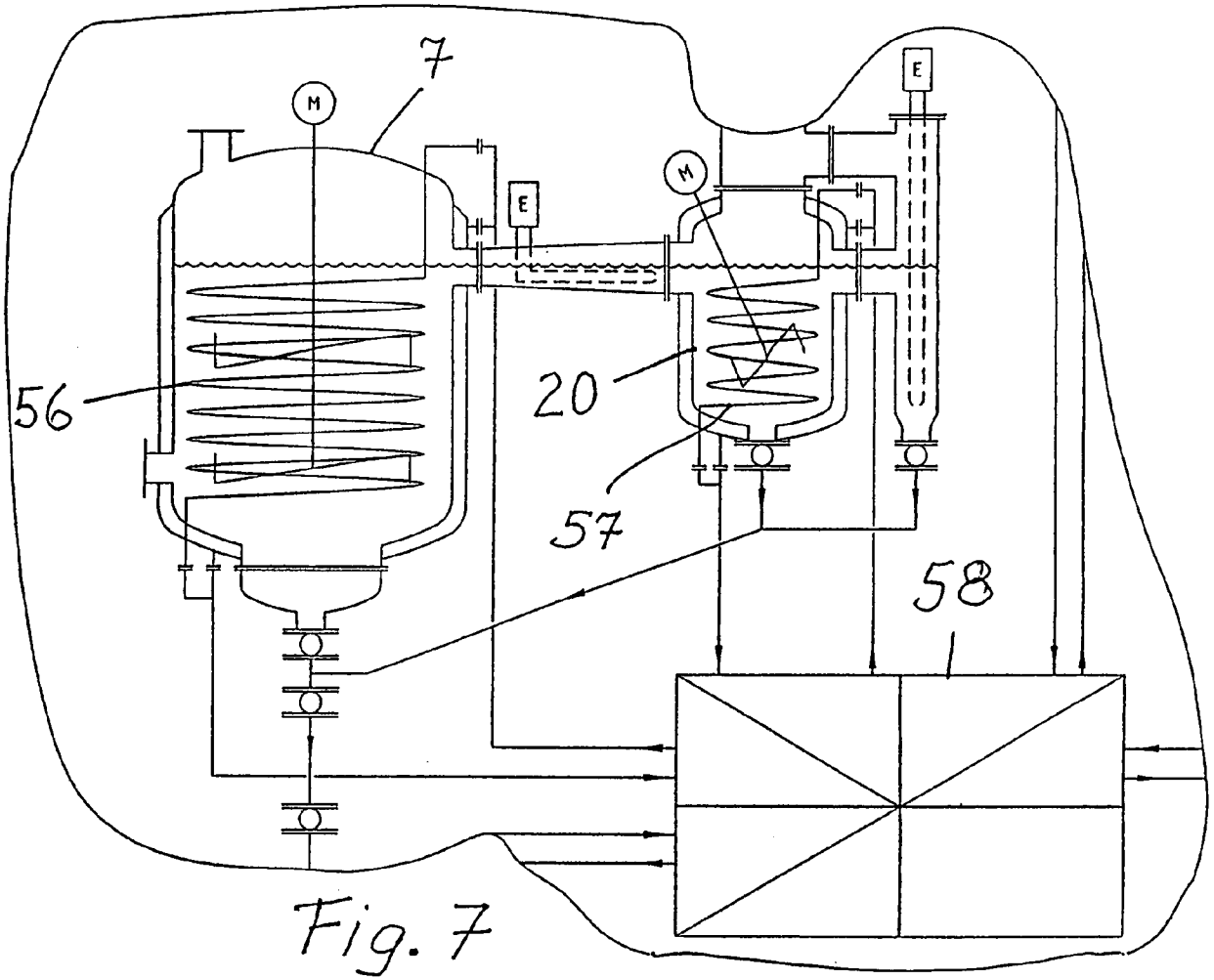

FIGS. 1*a*, 1*b* and 1*c* a processing installation distributed over three figures, for recovering fractional hydrocarbons from reclaimed plastic materials and/or from oily residues, FIG. 2 a feed system that has been modified as compared to that of FIG. 1, FIG. 3 a processing installation similar to that of FIGS. 1*a*, 1*b* and 1*c*, in which the heat-transfer medium circuit and the cooling circuit are shown in greater detail, FIG. 4 another feed system of a processing installation FIG. 5 another feed system of a processing installation having a cooling jacket around the feed pipe and a tamping screw jacket upstream from another melting tank, FIG. 6 another example of a main condenser and FIG. 7 another processing installation, similar to that of FIG. 3.

PREFERRED EMBODIMENT OF THE INVENTION

The processing installation for recovering fractional hydrocarbons from reclaimed plastic materials and/or from oily residues, as shown in the figures, consists of a silo 1 in which the reclaimed plastic materials to be processed are stored, preferably in the shredded state. They can also be stored in a bunker. In order to remove the reclaimed plastic materials, a motor-driven trough conveyor screw 2 that is designated with the letter "M" is connected to the silo 1, and said trough conveyor screw 2 conveys the material into a transfer tank 3, for example, a flanged spherical housing that allows a flexible adaptation to differing local circumstances. The transfer tank 3 is upstream from a tamping auger 4 or tamping mechanism that compacts the reclaimed plastic materials, thereby largely expelling the air and thus the oxygen. The lower end of the tamping auger 4 or tamping mechanism opens into a melting tank 7, above or below its filling level. A pneumatically actuated throttle-check fitting 5 is arranged between the end of the tamping auger 4 or tamping mechanism and the mouth that opens into the melting tank 7, and said throttle-check fitting 5 is upstream from a feed fitting 6 in the form of a ball valve 6.

The lower end of the melting tank 7 has a sedimentation compartment 10 in order to receive and concentrate a residue fraction that precipitates out of the liquid phase of the compacted mass. The sedimentation compartment 10 is connected through piping to a residue pre-cooling tank 15 via three residue discharge fittings 11, 12 and 13 arranged consecutively in a row, said residue pre-cooling tank 15 having a cooling jacket 14 on the outside. The residue is collected from a cooling system 34 and cooled inside the residue pre-cooling tank 15 by means of a cooling medium, preferably to below 120° C. [248° F.]. The residue is pre-cooled with the possibility of heat return into the heating system, resulting in a reduction of the temperature gradient between the melting tank 7 and an emulsion unit 16 located downstream.

The cooled residue is fed through piping to the emulsion unit 16 in which an oil-water emulsion is produced from the residue fraction by means of a motor-driven agitator. The reduction of the temperature gradient also reduces the necessary water seal in the emulsion unit 16, as a result of which a higher oil concentration is possible in the oil-water emulsion and consequently, its calorific value is raised.

The melting tank 7 has an agitator 9 for homogenizing the melted plastic mass as well as a scraper 17 for scraping off the inner wall of the melting tank 7 in the area of the mouth of the tamping auger 4 or tamping mechanism. Moreover, the melting tank 7 is closed at the top and has a lateral outlet A in its upper section. As a result, the bottom area of the upper tank is very strong, thanks to the reduction in the number of openings. Moreover, the melting tank 7 is surrounded by an exterior heating jacket 8 which is constructed in such a way that the heat input is homogenous and especially heat peaks are avoided during operation. By the same token, the exterior heating jacket 8 allows heat discharge and condensation before maintenance work or else in case of a breakdown.

Moreover, the melting tank 7 and the evaporation tank 20 can be fitted with, for example, two suspended concentric tubular coils. The use of tubular coils for heat transfer translates into a larger surface area for the transfer.

The plastic mass is heated up inside the melting tank 7 so that a separation into a first liquid phase, a first gas phase and a residue fraction occurs, after which the liquid phase and the first gas phase are transported through piping via the outlet A into an evaporation tank 20 in which, under further heat input into the mass, a second liquid phase and a second gas phase are created. The evaporation tank 20 serves to evaporate reclaimed material fractions with higher evaporation temperatures. The outlet A of the melting tank 7 or the inlet A of the evaporation tank 20 can have an additional heating unit 18 such as an electric immersible heater that can be followed by another intermediate heater 19 in order to increase the heat input into the intake of the evaporation tank 20.

The heat input into the evaporation tank 20 is regulated in a controlled manner via a heating jacket 21 and/or heating coils at a higher level than in the melting tank 7 and the heat input goes into a reduced quantity of plastic, resulting in a reduction in the amount of energy at the high temperature level. The evaporation tank 20 also has a motor-driven agitator 22 for homogenizing the melted reclaimed material. A second liquid phase and a second gas phase are formed inside the evaporation tank 20.

Parallel to the evaporation tank 20, a re-heating tank 23 is connected through piping and it has its own heating unit 24, which can be an electric heater E. The re-heating tank 23 serves to further re-heat and evaporate an even smaller amount of reclaimed material fractions than in the evaporation tank 20 at the highest evaporation temperatures of the reclaimed material fractions, so that a third gas phase is formed there. The evaporation tank 20 is closed at the bottom by means of a residue discharge fitting 25, for example, of the ball valve type, so that residues can be discharged. The re-heating tank 23, in turn, has a drain fitting 26 at its lower end in order to drain the re-heating tank 23.

A cracking tower 27 is mounted on the evaporation tank 20 and said cracking tower 27 serves to break up the long-chained molecules into short-chained molecules; the resultant oil gas is separated from the high-boiling constituents in the cracking tower 27. The re-heating tank 23 is also connected through piping to the cracking tower 27 so that the second gas phase from the evaporation tank 20 as well as the third gas phase from the re-heating tank 23 are fed into the cracking tower 27. Via a product gas line 28, namely, a pipeline 28, the product gas being formed in the cracking tower can be branched off into a pre-condenser 29 that functions as a heat exchanger in order to recover heat at a high temperature level, so that this pre-cooling of the product gas takes place with the possibility of heat recuperation to return to the heating system. The oil gas is then fed to the main condenser 30 in which the oil gas is condensed to form liquid oil.

The main condenser 30 has two cooling circuits, namely, a sump cooling condenser 31 and a head cooling condenser 32. The main condenser 30 has an inlet line and an outlet line with a circulation pump 35 for circulating the oil. In the line, there are likewise two automatic fittings with a throttle function in order to switch over and divert the circulating flow to the main condenser 30 or into a transfer line 37 to a separator (not shown here). The line also has a metering point 40 as an inoculation point for metering in additives, for example, in order to condition and stabilize the product oil as well as to set the product properties.

The additive can also be added in the line between the cracking tower and the main condenser.

Moreover, the main condenser 30 is connected through piping via a residual gas exhaust 39 to a heating system 38 of the processing installation, whereby the non-condensable fraction of the product gas is bled off via the residual gas exhaust 39 into the heating system 38 of the processing installation for purposes of thermal recovery in the heating system.

By using the processing principle of quenching, the main condenser achieves a very fast cooling and condensation of the hot product gas (shock cooling) to a mean temperature level of 80° C. to 200° C. [176° F. to 392° F.].

Cooled condensate (product oil) is used as the quenching medium. The quenching can be carried out in two different ways in terms of the equipment: the hot gas flow is sucked into the liquid circulating flow from cooled condensate, where intense heat exchange and immediate condensation of the product gas occur as a result of the high turbulence. As an alternative, the quenching apparatus can be configured as a packed column in which a liquid circulating flow consisting of cooled condensate trickles over the packings and hot product gas flows in a countercurrent from the bottom to the top, condensing in the process. Due to the large surface of the packings, an intense heat exchange takes place between the cold condensate and hot product gas, so that the latter immediately condenses.

Consequently, an arrangement having two packed columns allows one column to be regenerated while the other is in regular operation, whereby in order to carry out the regeneration, the circulating flow is switched off in the packed column that is to be regenerated and the hot gas flow coming from the cracking tower is fed through the packed column that is to be regenerated, as a result of which the packing in the column is heated up and deposits are removed. Therefore, the regeneration of the packed columns is carried out alternatingly.

In another modification of the invention, the heat exchangers of the main condenser do not necessarily have to be arranged inside the condenser, for example, as a sump cooling condenser and a head cooling condenser, but rather, it is sufficient to install a heat exchanger in the line of the circulating flow.

The heating system preferably has multiple circuits in order to generate the necessary process heat at the temperature level optimized for this purpose. Oil or salt or gas can be used as the heat-transfer medium in order to transport heat at a regulatable maximum heating temperature. The efficiency of the heating system is maximized in that heat is returned into the system, making use of the residual gas as fuel for the heating system. Thus, the method according to the invention can do without the separate gas combustion and gas flares that are needed with the state of the art. Maximum energy utilization is also ensured because, due to several optimized temperature levels, a flexible heating of the heating system is possible, namely, by the product oil, by the product gas and by an oil-water emulsion as well as electrically or through a combination of the various above-mentioned energy sources. Moreover, the occurring temperature differences, the different pressures and the different flow quantities of the heat-transfer medium circuits can be used in order to ascertain and to monitor the energy quantities.

FIG. 2 shows a feed system that has been modified in comparison to the one shown in FIG. 1. The connection pipe of the melting tank 7 for connecting the tamping auger 4 or tamping mechanism is shaped here onto the melting tank at an acute angle; otherwise, the configuration is the same.

FIG. 3 shows a processing installation that is very similar to FIGS. 1*a*, 1*b* and 1*c* and in which the heat-transfer medium and cooling circuits are shown in their entirety. The heating system 38 is divided into five heat-transfer medium circuits, WT1 to WT5. WT1 is connected via lines to the melting tank 7 and supplies it with heat energy; by the same token, WT2 is connected to the evaporation tank 20. WT3 and WT4 and WT5 are connected to the pre-condenser 29, to the cooling system 34 and to the residue pre-cooling tank 15, respectively.

FIGS. 4 and 5 show two additional examples of different feed systems of a processing installation according to the invention. The melting tanks 7 shown here have an upper filling vent 40 through which a feed pipe 41 passes, whose opening is below the liquid level 42 of the liquid melted mass. In FIG. 5, the feed pipe 41 and the tamping auger are additionally surrounded with a cooling jacket 43 through which cooling water flows.

FIG. 6 shows another example of a main condenser 44 of the processing installation according to the invention. The hot gas enters through the opening 45 into the main condenser 44 and flows through packing columns 46 in which packings are present, for example, rings made of stainless steel. Liquefied condensate is withdrawn from the sump 54 via a line 47 and fed by a pump 48 to two series-connected heat exchangers 49, 50 and cooled off further, said heat exchangers 49, 50 being connected to two cooling circuits, namely, cooling circuit I and cooling circuit II. Via a return line 51 downstream from the second heat exchanger 50, cooled condensate is fed in a countercurrent back to the main condenser 44, as can be seen in FIG. 6. As a result, the gas flowing through the packing columns 46 is cooled off abruptly. Via the outlet 53 situated at the top, which corresponds to the outlet 39 in FIG. 1*c*, non-condensed residual gas is either used as combustion gas or else another condenser can be installed here by means of which any fractions of hydrocarbons still present in the residual gas are condensed. The liquid oil, the target product of the processing installation, is withdrawn via a branch-off line 52 down-stream from the second heat exchanger 50 and upstream from the return line 51.

FIG. 7 differs from FIG. 3 essentially only in that additional heating coils 56, 57 are installed in the melting tank 7 as well as in the evaporation tank 20 in order to increase the introduction of heat into the masses. As shown in FIG. 7, in order to obtain a heat supply, these heating coils 56, 57 are connected to their own heat-transfer medium circuits, namely, WT-circuit 1 and WT-circuit 2 of the heat-transfer medium heating system 58 which is either gas-oil-fired—for example, with the residual gas from the main condensers 30 or 44—or else heated electrically. When heating coils are used, the outer heating jacket can also be omitted.

An amount of 100 kg of dry, clean and pure reclaimed plastic materials give rise to about 75 to 90 kg of product oil, 2 to 12 kg of residues and 2 to 15 kg of non-condensable gases for thermal recovery in the heating system. The yield of product oil depends, among other things, on the types of plastic that served as feedstock.

COMMERCIAL APPLICABILITY

The method or cracking method and the device according to the invention can be used commercially in the branches of industry involved in the hygienic processing in order to recover reclaimed plastic materials and/or oily residues or plastic waste and/or oily waste.

LIST OF REFERENCE NUMERALS

1 silo
2 trough conveyor screw
3 transfer tank
4 tamping auger or tamping mechanism
5 throttle-check fitting
6 feed fitting
7,39 melting tank
8,21 heating jacket
9,22 agitator
10 sedimentation compartment
11,12,13,25,26 residue discharge fittings
14,43 cooling jacket
15 residue pre-cooling tank
16 emulsion unit
17 scraper
18 heating unit of the intermediate heater 19
19 intermediate heater
20 evaporation tank
23 re-heating tank
27 cracking tower
28 pipeline
29 pre-condenser
30,44 main condenser
34 cooling system

38 heating system
39,53 outlets
40 upper filling vent
41 feed pipe
42 liquid level
45 opening of the main condenser
46 packing columns
47 line
48 pump
49,50 heat exchanger
51 return line
52 branch-off line
56,57 heating coils
A outlet

The invention claimed is:

1. A method for recovering fractional hydrocarbons from reclaimed plastic materials and/or from oily residues, said reclaimed plastic materials and/or residues being sorted according to type and compacted using a feed system (1,2,3,4) in the absence of air, after which the compacted mass is fed to a melting tank (7) where the compact mass is heated, so that a separation occurs into a first liquid phase, a first gas phase and a residue fraction, after which the liquid phase and the first gas phase are transported into an evaporation tank (20) in which a second liquid phase and a second gas phase are formed under continued heat input, whereby the second liquid phase is transferred to a re-heater (23) and additionally heated there under further heat input so that a third gas phase is formed, after which the second gas phase from the evaporation tank (20) and the third gas phase from the re-heater (23) are conveyed to a cracking tower (27) where further cracking of the long-chained hydrocarbons into short-chained hydrocarbons takes place, and the resulting oil gas is then conveyed to a condenser (30) in which the oil gas is condensed to form liquid oil, whereby the oil constitutes the target product.

2. The method according to claim 1, wherein the method is carried out using a multi-circuit heating system (38) for generating the necessary process heat and it generates the process heat for the melting tank (7), for the evaporation tank (20) and for the re-heater (23), whereby oil or salt or gas can be used as the heat-transfer medium.

3. The method according to claim 1, wherein in order to feed the reclaimed plastic materials and/or the oily residues into the melting tank (7), a tamping auger (4) or tamping mechanism that compacts the residues in order to remove the oxygen is used within the feed system and feeds them into the melting tank below a liquid level.

4. The method according to claim 1, wherein the middle fraction and the heavy fraction of the hot oil gas or cracked gas is cooled off abruptly by means of quenching with cold condensate down to a moderate temperature level, in which process it is condensed so that, at the same time, hydrocarbons having a medium to long chain length condense.

5. The method according to claim 4, wherein in order to carry out the quenching procedure, the gas flow is either sucked into the cold, liquid circulating flow or else it is passed over two packings in packed columns that are operated in a counter current, whereby cold condensate trickles over the packings.

6. The method according to claim 4, wherein an arrangement having two packed columns allows one column to be regenerated while the other is in regular operation, whereby in order to carry out the regeneration, the circulating flow is switched off in the packed column that is to be regenerated and the hot gas flow coming from the cracking tower is fed through the packed column that is to be regenerated, as a result of which the packing in the column is heated up and deposits are removed.

7. The method according to claim 1, wherein in order to generate the primary process heat, a non-condensable fraction of the oil gas is fed to the heating system where it can be burned for purposes of thermal recovery.

8. The method according to claim 1, wherein the oil-water emulsion can be fed to the heating system (38) where it can be burned for purposes of thermal recovery.

9. The method according to claim 1, wherein a pre-condenser (29) and a main condenser (30) are used as the condenser, and the excess heat from the pre-condenser (29), main condenser (30) and residue pre-cooling tank (15) is fed to the heating system (38), whereby the main condenser is connected to a multi-circuit condensation system.

10. The method according to claim 1, wherein the reclaimed plastic materials and/or the oily residues are comminuted after having been sorted and, if applicable, they are dried before the cracking process is carried out.

11. The method according to claim 1, wherein the residue fraction is transported inside the melting tank (7) into a sedimentation compartment (10) located underneath where the residue fraction is concentrated and subsequently the concentrated residue fraction is transferred into a residue pre-cooling tank (15) where the residue fraction is cooled by means of a cooling medium from a cooling system (34), preferably to a temperature below 120° C., (248° F.).

12. The method according to claim 1, wherein the cooled residue fraction is fed to an emulsion unit (16) in which an oil-water emulsion is produced from the residue fraction.

13. The method according to claim 1, wherein the pre-condenser (29) is arranged between the cracking tower (27) and the main condenser (30), whereby the pre-condenser (29) pre-cools the oil gas in order to recover energy at a high temperature level, as a result of which the temperature gradient between the cracking tower (27) and the main condenser (30) is reduced.

14. The method according to claim 1, wherein the main condenser (30) and optionally the pre-condenser (29) are connected to a multi-circuit cooling system (34).

15. A method according to claim 1 wherein the compacted mass is fed to a melting tank (7) below a liquid level.

16. A device for recovering fractional hydrocarbons from reclaimed plastic materials and/or from oily residues, said reclaimed plastic materials and/or residues being sorted according to type, characterized by a feed system (1,2,3,4) for compacting the reclaimed plastic materials and/or oily residues in the absence of air, as well as by a downstream melting tank (7) for heating and melting the compacted mass in order to create a first liquid phase, a first gas phase and a residue fraction, whereby an evaporation tank (20) is arranged downstream from the melting tank (7) in order to create a second liquid phase and a second gas phase under continued heat input, said evaporation tank (20) being upstream from a re-heater (23) for purposes of feeding and further heating the second liquid phase so as to create a third gas phase, and a cracking tower (27) is connected to the evaporation tank (20) and to the re-heater (23) in order to crack the long-chained hydrocarbons into short-chained hydrocarbons, and a condenser (30) is connected to the cracking tower (27) in order to condense the oil gas to form liquid oil.

17. The device according to claim 16, wherein in order to feed the reclaimed plastic materials and/or the oily residues into the melting tank (7), a tamping auger (4) or tamping mechanism for compacting the reclaimed plastic materials and/or the oily residues is arranged within the feed system and, if applicable, a spherical transfer tank (3) is located upstream from said tamping auger or tamping mechanism for purposes of transferring material into the tamping auger (4) or tamping mechanism.

18. The device according to claim 16, wherein the outlet of the tamping auger (4) or tamping mechanism opens into the melting tank (7) below the liquid level of the melted mass.

19. The device according to claim 16, wherein said device has a multi-circuit heating system (38) for generating the necessary process heat at a temperature level that has been optimized for this purpose, whereby oil or salt or gas serves as the heat-transfer medium.

20. The device according to claim 16, wherein a sedimentation compartment (10) is arranged underneath the melting tank (7) in order to receive the residue fraction.

21. The device according to claim 19, wherein a residue pre-cooling tank (15) with an emulsion unit (16) connected to it is arranged on the sedimentation compartment (10) in order to produce an oil-water emulsion from the residue fraction.

22. The device according to claim 17, wherein the condenser consists of a main condenser (30) and a pre-condenser (29), and the pre-condenser (29) is arranged between the cracking tower (27) and the main condenser (30) in order to precool the oil gas.

23. The device according to claim 17, wherein a multi-circuit cooling system (34) is connected to the main condenser (30).

24. The device according to claim 17, wherein said device has a multi-circuit heating system (38) for generating the process heat for the melting tank (7), evaporation tank (20) and re-heater (23).

25. The device according to claim 17, wherein the melting tank (7) and the evaporation tank (20) as well as, if applicable, the re-heater (23), have an exterior heating jacket (8, 21) and/or heating coils (56,57), which can be heated up by means of the shared heating system (38) for the heat-transfer medium.

* * * * *